US011628680B1

(12) United States Patent
Milcheck

(10) Patent No.: US 11,628,680 B1
(45) Date of Patent: Apr. 18, 2023

(54) 2 PIECE EGG HOLDER

(71) Applicant: Kevin James Milcheck, Mount Dora, FL (US)

(72) Inventor: Kevin James Milcheck, Mount Dora, FL (US)

(73) Assignee: Kevin J. Milcheck

( * ) Notice: Subject to any disclaimer, the term of this patent is extended or adjusted under 35 U.S.C. 154(b) by 29 days.

(21) Appl. No.: 16/350,654

(22) Filed: Dec. 15, 2018

Related U.S. Application Data

(60) Provisional application No. 62/708,616, filed on Dec. 16, 2017.

(51) Int. Cl.
*A47G 19/28* (2006.01)
*B44D 3/00* (2006.01)

(52) U.S. Cl.
CPC ..... *B44D 3/00* (2013.01); *A47G 19/28* (2013.01)

(58) Field of Classification Search
CPC ..... B05C 13/02; A23L 15/40; A23L 15/42
USPC ..... 269/309; 99/298 T, 440; 294/27.1, 31.1, 294/32, 57; 118/13, 26
See application file for complete search history.

(56) References Cited

U.S. PATENT DOCUMENTS 1,272,318 A * 7/1918 Rogers ..... A47J 45/068 99/342
4,371,555 A * 2/1983 Tully ..... A23L 15/00 426/104
2007/0210594 A1* 9/2007 Wong ..... B44D 2/002 294/14

* cited by examiner

*Primary Examiner* — Lee D Wilson
*Assistant Examiner* — Alberto Saenz

(57) ABSTRACT

The egg handle, egg stands, and drying stands are used in combination to dye and dry the decorated eggs. The egg handle is easily separated from the egg stands which would allow a user to separate an existing dyed egg from the handle while placing a new egg stand on the handle and dye an entirely different egg, while the previous egg is allowed to dry. Two different egg stands examples are provided which allow a user to dye an egg whether in a vertical position or a horizontal position. Additionally, containers are provided that directly fit the egg stand to hold an egg steady and prevent the egg from rubbing the side of the container.

21 Claims, 8 Drawing Sheets

Figures 1, 2, 3:
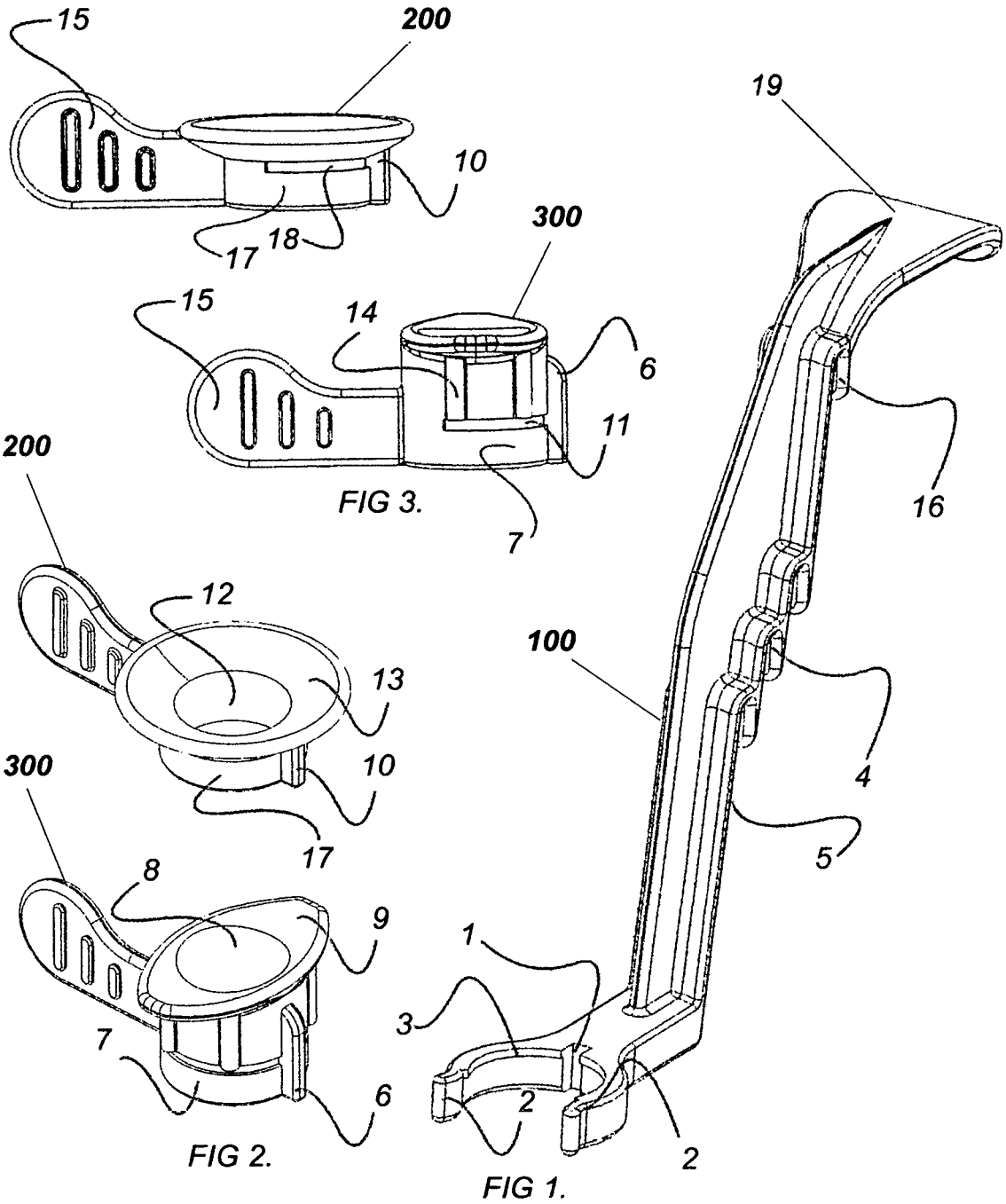

15
200
10
17
18
300
15
14
6
11
7

200
12
13
10
17
300
8
9
7
6

19
16
100
4
5
1
3
2
2

FIG 4.
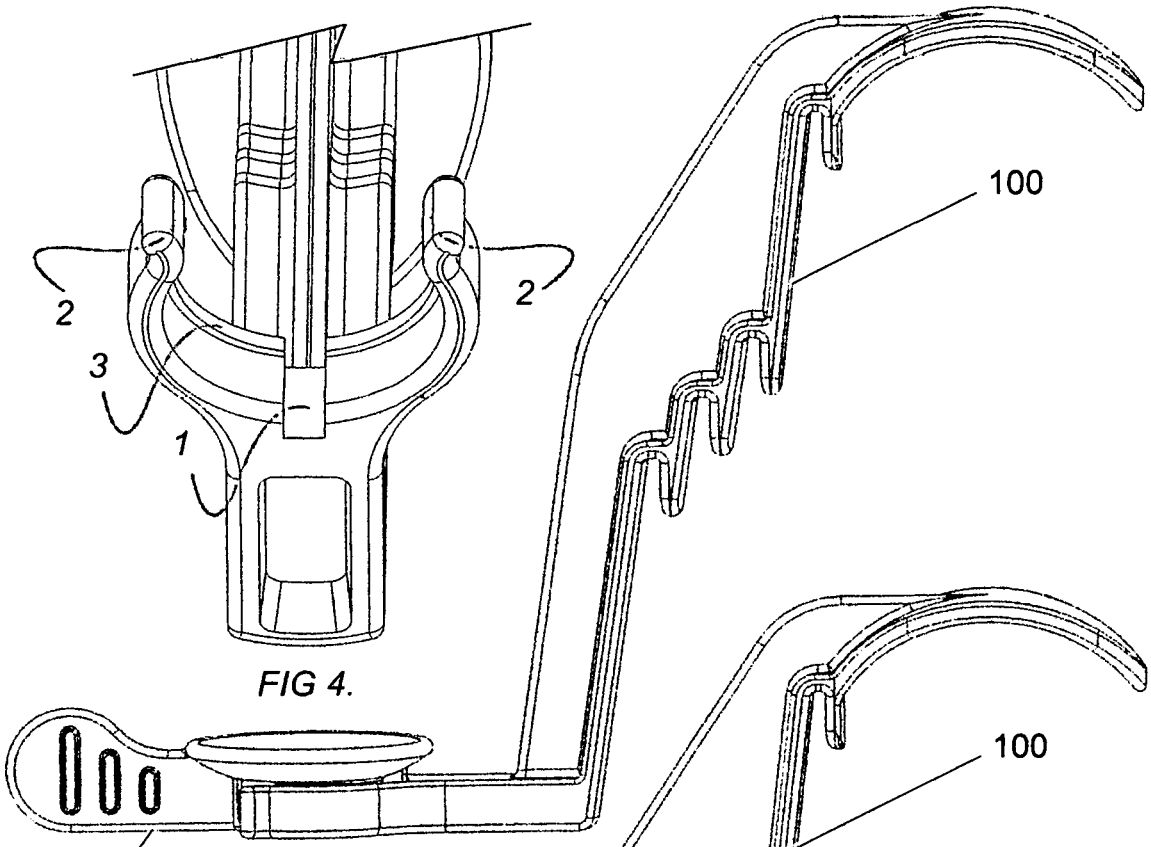
FIG 5.
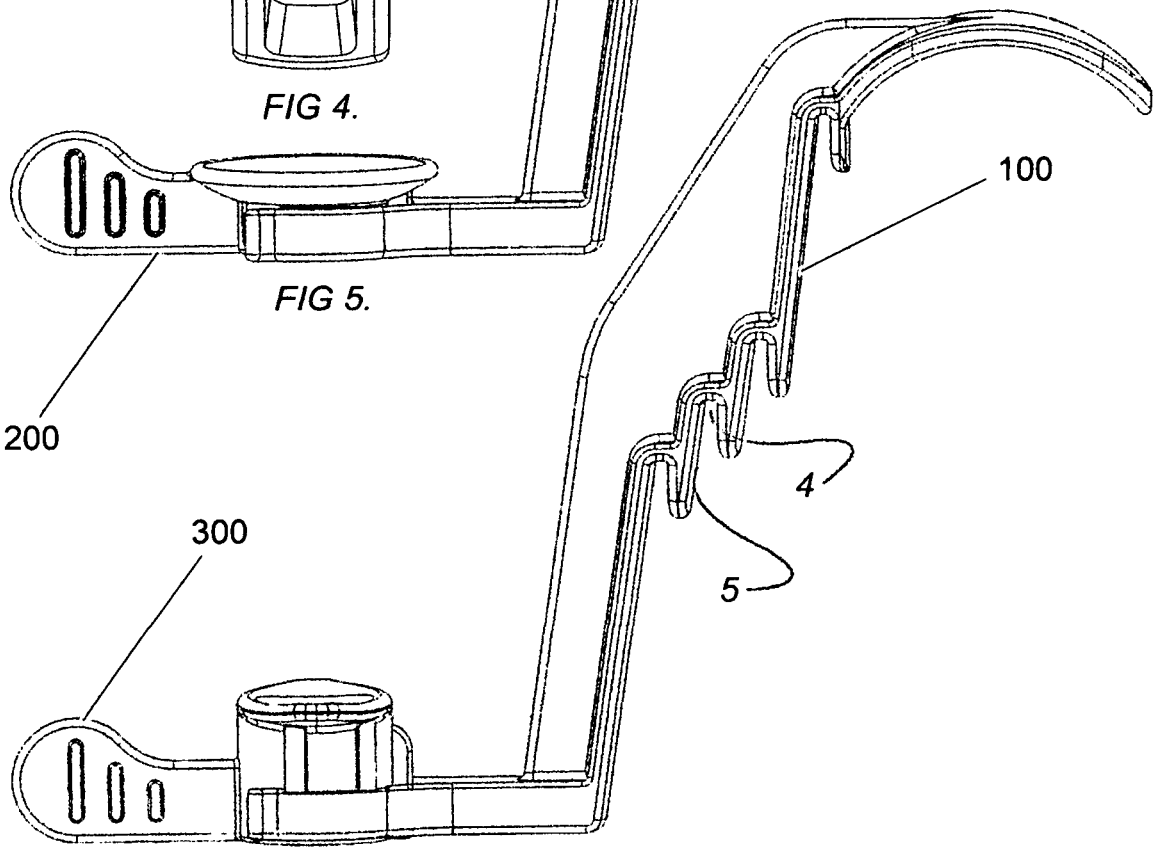
FIG 6.

2 PIECE EGG HOLDER

1. FIELD OF THE INVENTION

The present invention is in the field of egg dyeing and decorating, and more specifically relates to egg holders and handles, egg stands, egg dyeing containers and associated methods.

2. BACKGROUND

Egg decorating has not changed very much in over the last 135 years. Whether one wanted to dye eggs in solid colors or a rainbow of colors utilizing colors floating on top of the water there was no need for a specialized dipping tool. One could simply use a spoon or a standard wire egg dipping device. Now that eggs can be dyed in distinct patterns in multiple colors using a soft wax that melts with body warmth to prevent color infiltration, there is a need to place an egg in the colors so as not to allow an egg to shift on the egg dipping device or by rubbing the side of the glass. This movement can cause the wax to be scratched or partially rubbed off ruining one's design, with the wax transferring to the glass, which can cause more problems for your future designs.

There are currently no egg holders that can accomplish this on the market today, that can prevent the egg from moving in an egg holder, allowing limited area touching the egg holder and egg and preventing an egg from touching the glass. This would most assuredly allow color intrusion to the eggshell surface ruining the design and dirty the glass with waxy build-up with the potential of ruining future designs.

Currently, there are no containers that are designed to fit a particular egg holder, since up until this point there was no need. There also are no containers that are specifically designed to limit the amount of water used, while still covering an egg that is standing in a vertical position and not touching the glass anywhere.

Pub No: US 2007/0210594 A1, Publication Date: Sep. 13, 2007 by Wong shows an egg holder where the egg goes through the holder itself by roughly ⅓ of the egg. This would limit one's ability to design on the eggshell surface, since the egg holder itself is obstructing much of the egg. The egg itself would touch the bottom of the glass and allow the egg to move, with a result of ruining one's design and also getting some wax material from the egg paste onto the glass, causing problems for future designs. The patent also has no mention of clearances between the egg and the handle, nor does it provide any stability or distancing of the egg from the glass. Pub No. U.S. Pat. No. 1,272,318, Publication date Jul. 9, 1918 by Rogers shows an egg holder with one similarity being an attachment point at the top of the glass. Rogers demonstrates an egg being suspended, covered by a ring of thin metal, which the simple covering of the egg with any part of any egg dipper has the potential of ruining a design, with the metal itself potentially obstructing the dye from fully covering an egg or causing friction on the egg itself, which would ruin eggs by rubbing the egg paste and potentially creating an entry for the dye to penetrate. Rogers' design does not account for dying an egg partially, such as raising the egg partially out of the water. Rogers suspension point does not hold the unit straight. The unit is being held straight by the full length of metal that rests against a vertical glass. If one would utilize Rogers design on a container that is not vertical, the egg would have a tendency to roll left or right and touch the side of the glass, thus ruining a design.

An egg paste is described in U.S. Pat. No. 1,089,555 B1 to the present Applicant and titled "Formulation to Stop the Adherence of a Dye to an Eggshell."

3. SUMMARY OF THE INVENTION

An egg dipper and containers for use in an egg decorating kit includes a handle and egg stands that are designed to easily slide and detach from the handle allowing one to easily set aside an egg to dry and snap on another egg stand to design another egg, while using containers that are designed to fit the egg holder handle to prevent any movement of the egg in the water, eliminating the egg from touching the side of the container with the ability to elevate the egg in different positions partially out of the water.

The handle may include two flexible protrusions that are designed to expand when forward pressure is exerted on them, such as sliding an egg stand into the handle and to snap around the egg stand securing the egg stand in place in all directions. The protrusions could also be on the egg stands or holders The shape of the parts are not limited to a particular shape as it could be, for example, round, or oval.

4. BRIEF DESCRIPTION OF THE DRAWINGS

FIG. 1: A front elevation view of the egg handle

FIG. 2: A top view of the horizontal and vertical egg stands

FIG. 3: A side elevation showing the horizontal and vertical egg stands

FIG. 4: A magnified section of the egg handle's stand connection

FIG. 5: A side elevation of the egg handle connected to the vertical egg stand FIG. 6: A side elevation of the egg handle connected to the horizontal egg stand FIG. 7: Rear elevation of the egg handles and egg stands FIG. 8: An elevation of an egg drying stand FIG. 9: A rear elevation of the egg handle and horizontal egg stand FIG. 10: A rear elevation of the egg handle and horizontal egg stand FIG. 11: A top elevation of the egg holder in a glass FIG. 12: A side elevation of the egg handle and vertical egg stand in a glass FIG. 13: A side elevation of the egg handle and horizontal egg stand in a glass FIG. 14: A side elevation of the egg handle and vertical egg stand in a glass utilizing one of 3 notches to raise the egg partially out of the dye FIG. 15: A front elevation of the horizontal and vertical egg stands with an egg FIG. 16: A side elevation of the egg handle and horizontal egg stand in a glass utilizing one of 3 notches to raise the egg partially out of the dye FIG. 17: A front elevation of the horizontal egg stand with an egg in a glass FIG. 18: A front elevation of the egg handle and horizontal egg stand demonstrating the stability of the attachment to the vertical/horizontal egg stand to the egg handle.

5. DETAILED DESCRIPTION OF PREFERRED EMBODIMENTS

FIG. 1, FIG. 2 and FIG. 3 depict an embodiment of the egg dipper, including the perspective view of the vertical axis, extended portion/body and handle which will be referred to as egg handle 100, a perspective view and side views of the vertical egg stand 200 and the perspective view and side views of the horizontal egg stand 300 as may be viewed in FIGS. 1, 2 & 3 used in an egg decorating kit that allows one to securely finish decorating an egg in distinct, multiple colors and avoid any marring of the designs when holding an egg, both in a horizontal and vertical position, in a plastic container (e.g. glass) 400 filled with dye and water as may be viewed in FIGS. 12, 13, 14, 16 and 17.

The egg dipper is designed to hold eggs in both a horizontal and vertical position through the use of the detachable egg stands 200 & 300 and the individual bases (or stabilizers) 9 & 13 as viewed in FIGS. 2 & 3 which may be devised relatively small if one chooses to utilize an adhesive paste, which can adhere an egg to the egg stands, when applied to the egg shell surface limiting the surface area required in 9 & 13 in FIGS. 2 & 3 to provide stability for an egg on the device.

Figure 12:
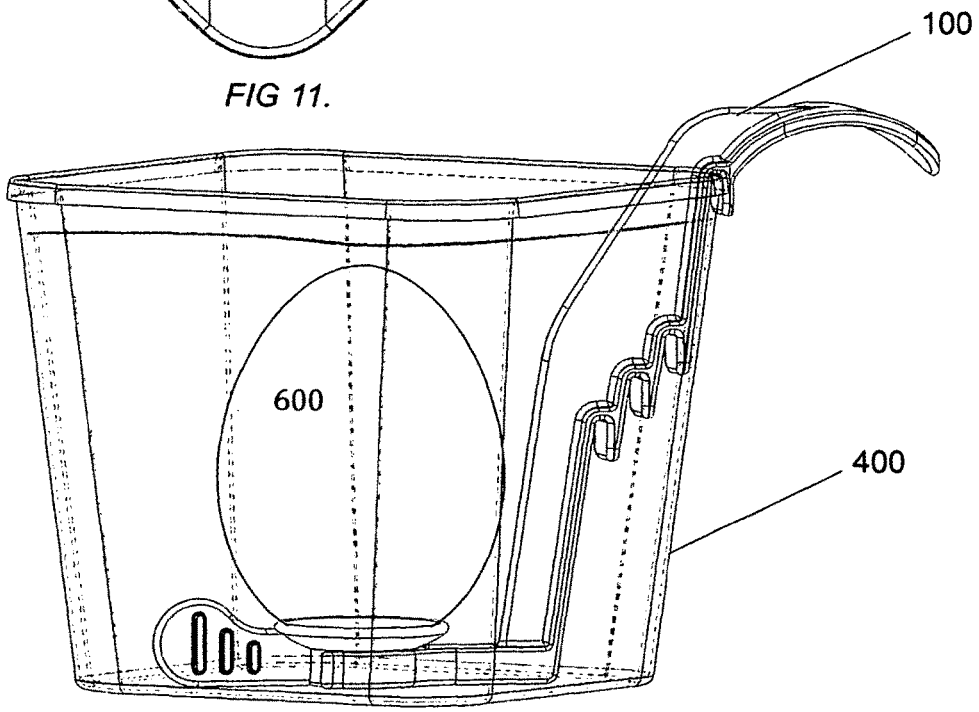
Figure 14:
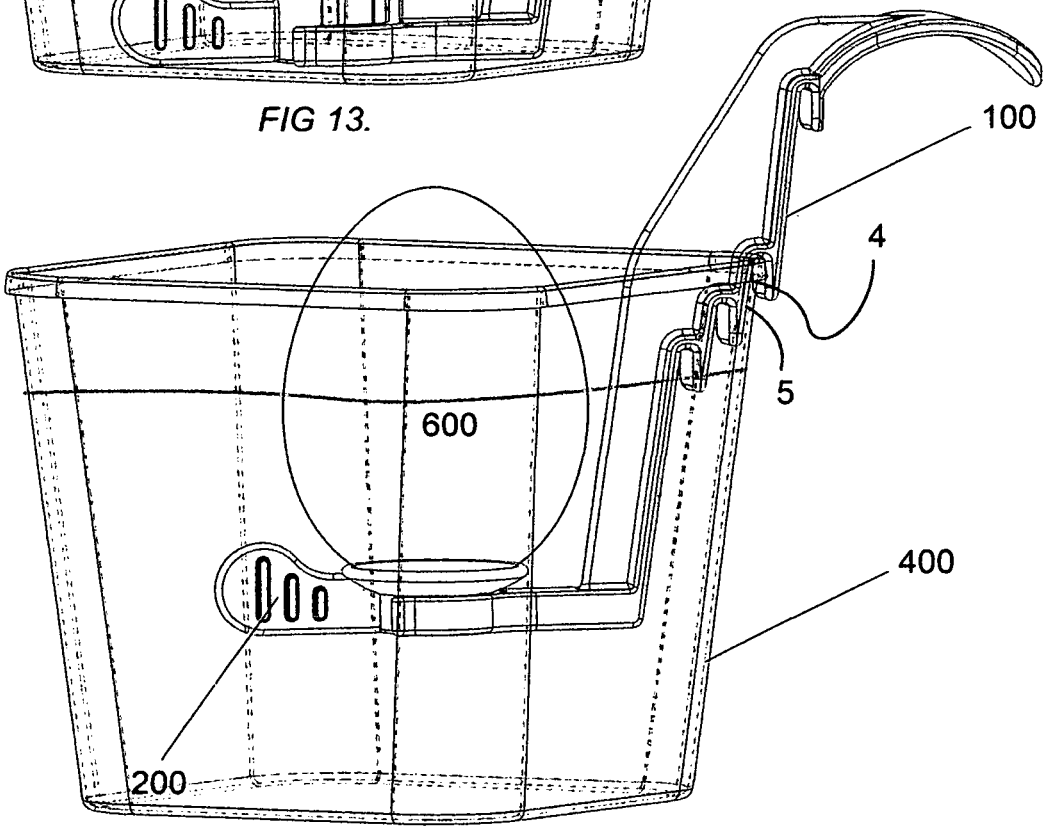

The individual bases 200 & 300 shown are examples of the many bases that are envisioned, with stability of the egg on the egg stands being an important factor along with the available amount of surface area of an egg to work on. Other examples and embodiments including these parameters are contemplated. Egg stand 200 for instance is round to accept a vertical standing egg as shown in FIGS. 12 & 14 formed to follow the contour of the bottom portion of an egg. The embodiment shown has a hole in the middle, which may be solid. The entire circumference of the holder could be smaller, so there is less material actually touching the egg shell. Stability on the stand is important and could be enhanced with the use of a paste to assist in holding an egg stable. The egg stand may take into account the stability that can be achieved with a paste and the particular structure.

Figure 15:
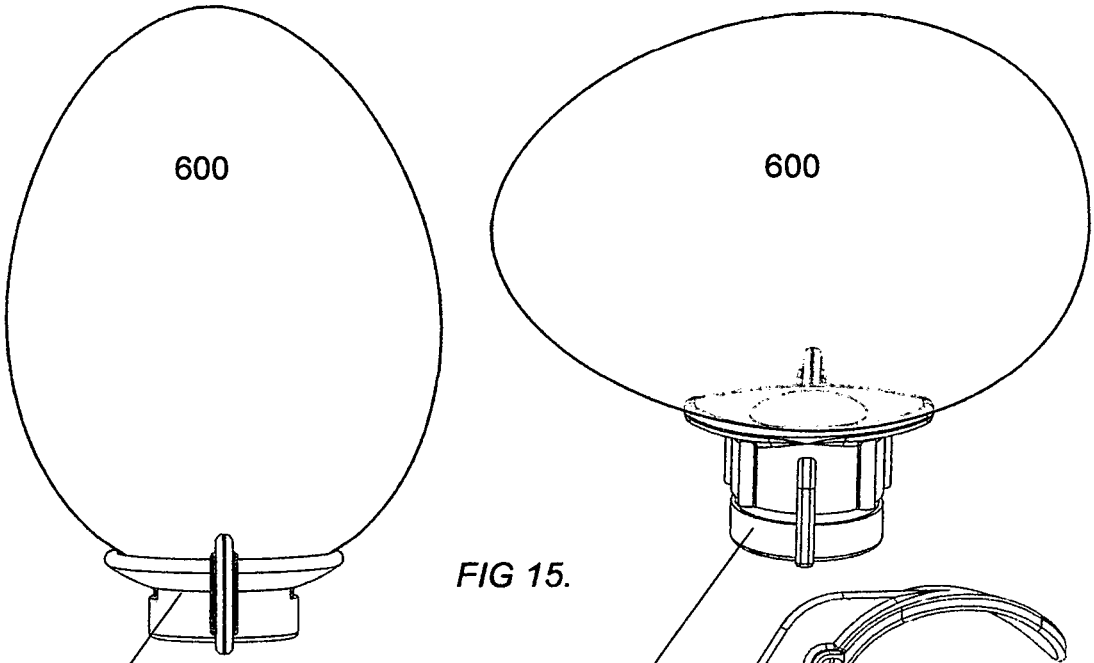
Figure 16:
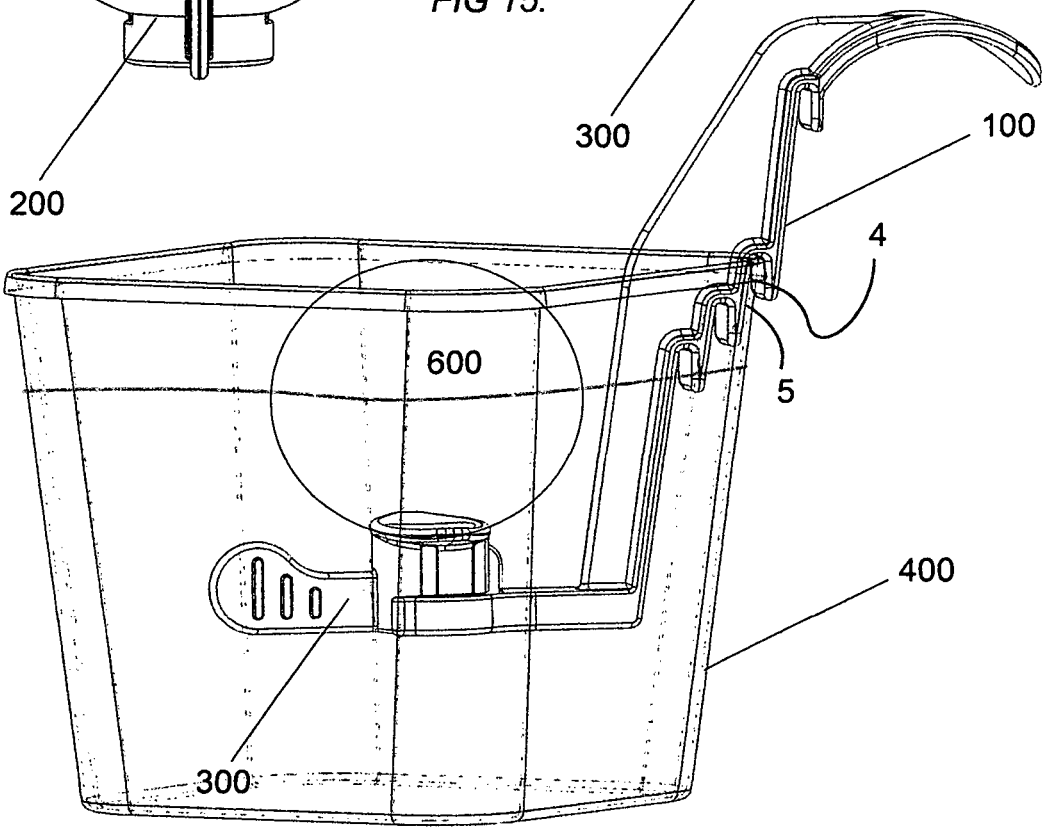
Figure 17:
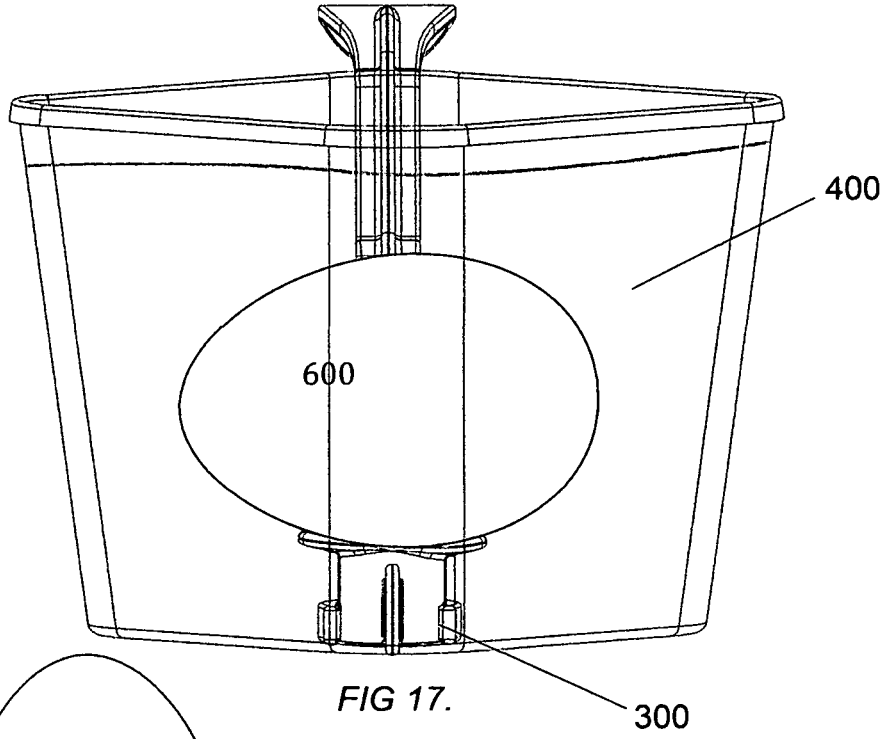
Figure 18:
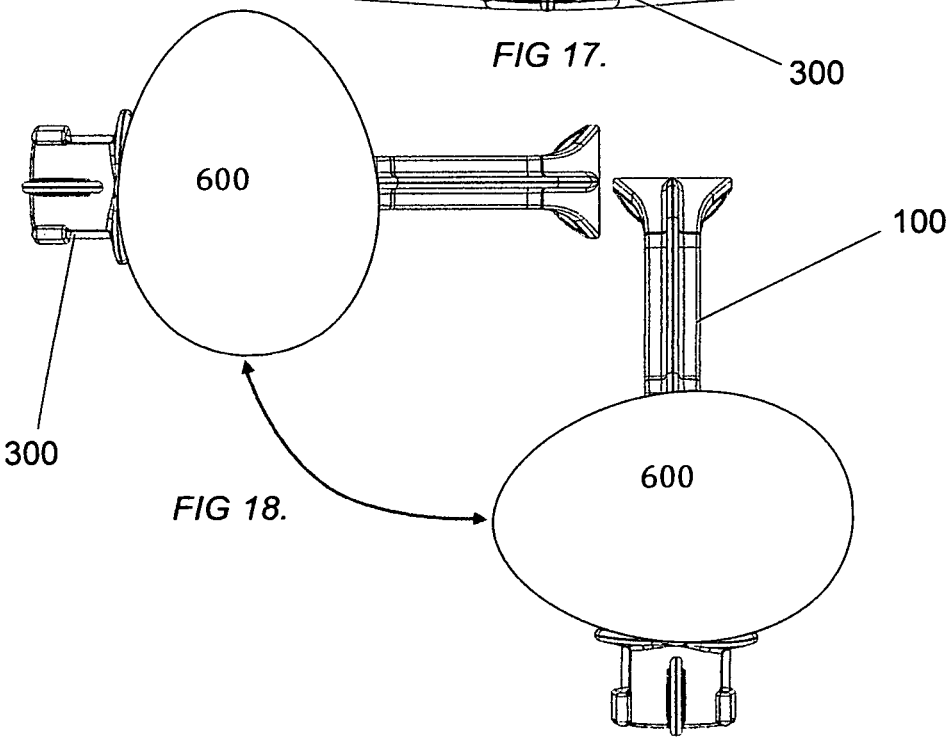

Egg stand 300 is designed for the egg lying horizontally as in FIGS. 15, 16, and 17. This can give a designer access to the ends of an egg, the top and bottom. The embodiment shown in 300 FIGS. 2 & 3 is an oblong oval to follow the natural shape of an egg to create stability, while providing as much surface area available to the consumer to work on the surface of an egg. Again, the center circle may be eliminated and sizes may vary, with the stability on the stand being important, and which may be enhanced with the use of an adhesive paste to hold an egg on the stand.

The egg handle 100 is designed with slot 16 as seen on FIGS. 1, 5 & 6 to securely hold the egg holder in place while an egg is fully submerged as in FIG. 12 or the egg holder can be raised utilizing slots 4, so only part of an egg is submerged in the dye as in FIGS. 14 and 16 with slot surface 5 providing support on the side of the glass to keep the egg level as seen in FIGS. 14 & 16. The number of slots 4 placed on the device may be increased in view of the manufacturer and consumer needs. Three slots 4 are used in the example embodiments, and the determination of how many to utilize may be based on several factors, one of which may be egg decorating and flexibility of certain desired egg designs. The length, width and clearance of each slot 4 is determined by the stability one wants to achieve while attached to the glass. This can be seen in FIG. 6 where slot 4 can be seen along with the slot surface 5 that would rest against the container. This can also be achieved with tightness of fit that slot 4 & 16 has with the rim of the glass 20 & 21 FIG. 11.

Figure 11:
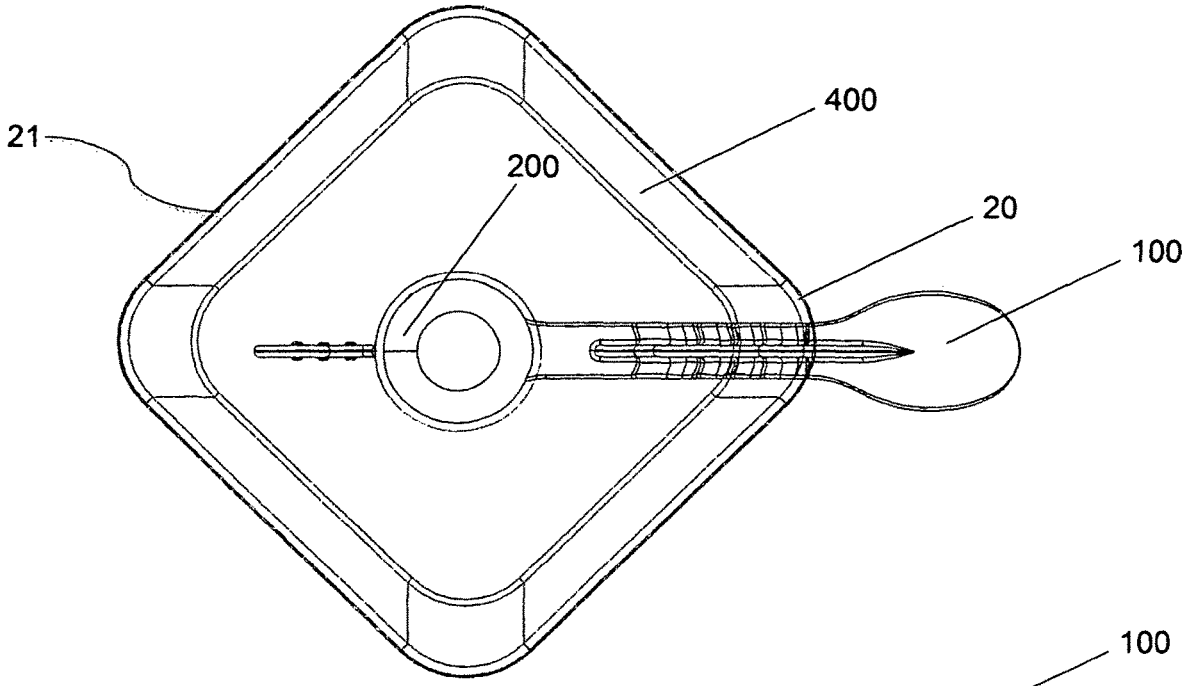

The egg handle 100 is designed with slots 4 & 16 to fit on the corner edges rim 20 or the side rim 21 of the container as can be seen in FIG. 11. The corner would be utilized when the device is fully submerged, which may also affect the chosen size and shape of the container. The long edge of a container 21 along with the corner edges 20 can be utilized raising an egg out of the water.

The ability to hold the handle with an egg is relatively straightforward with the embodiment of egg handle 100, with the top of the handle 19 FIG. 1 giving a large area for one's thumb and the underside of handle 19 which gives a large area for one or two fingers, thus forming a cantilever with the top of handle 19 having a slight bend to it to improve functionality and feel.

The egg handle 100 is proposed to have detachable egg stands 200 and 300. This is accomplished by pressing the two parts together as in FIGS. 5 & 6, which shows the egg stands attached to the egg handle. The two protrusions 2 in the egg handle which are better viewed in FIG. 4, extend outward when pressure is exerted on them from base 7 and 17 from egg stands 200 and 300 FIGS. 2 & 3. The drawings show circular geometry, but the effect can be achieved with different geometries, oval, for example. No lifting of either part is required to make the attachment.

The protrusions 2 as shown in FIG. 4 can extend 180 degrees or slightly farther than 180 degrees to wrap around base 7 and 17 with more distance increasing the tightness of the fit and potential exertion of inserting and removing the two parts. Two indentations can be placed at the 180 degree mark on base 7 & 17 to signify a clipping point and holding the pieces together as opposed to extending the protrusion legs passed the 180 degree point. The same can be accomplished with, for example, an oval shape, square or triangular shape of the pieces as opposed to the circular shape shown. The outer edge of protrusions 2, which can be viewed best on FIG. 4 may have a slight outward bevel, making it easy to match up and slide the two pieces together.

The protrusions 2 of egg handle 100 may be replaced by the face of base 7 or 17 from the egg holders and the face of base 7 or 17 replaced by the protrusions 2 of the handle 100. In essence, swap the sections of the two parts.

The indention 1 of the egg handle 100 as can be seen in FIGS. 1 & 4 is placed to accept the protrusions 10 and 6 of the egg stands 200 and 300 as can be seen in FIG. 2. This will prevent any rotation of the two parts. One example is shown with many available ways to achieve the same goal with similar geometry.

The protrusion 3 of egg handle 100 is best viewed on FIG. 4 is meant to fit into slot 11 & 18 of egg stands 200 & 300 FIG. 3. The height, running length, geometry and exact vertical position can be varied, with one goal of preventing tilting of the egg stand and the egg handle and create a more solid feel of the two pieces. Along with this detail are projection 14 in FIG. 2 and FIG. 3 and egg disk (or stabilizer) 13 in FIG. 2 which impart even more stability between the egg handle and the egg stands by touching the top edge of the extended portion/body defining a longitudinal axis extending in a direction substantially perpendicular to the vertical axis of the handle of egg handle 100. The protrusion 3 can be converted to slot 3 in the egg handle 100 and a protrusion instead of a slot 11 & 18 of egg stands 200 & 300.

Egg stand handle 15 of FIG. 3 is curved and shaped to allow a user to easily attach the egg stand to the egg handle or separate the two by gripping and applying pressure in either direction whether attaching or separating the two pieces. The egg handle 15 can also have projections on it to help with gripping the handle, whether vertical projections as seen in FIGS. 2 & 3, numerous projected dots may be utilized with other similar embodiments. The egg stand handle is designed to keep the users fingers away from the egg and avoid touching and possibly ruining an egg design.

The length of particular embodiments of the egg handle 100 may be varied with many factors that come into play including the actual size of the containers needed, distance needed away from the actual egg, etc.

Egg stand 200 is intended to hold an egg vertically which can be viewed in FIGS. 5, 9, 12, 14 & 15. The diameter of the actual stand can vary and become very small with the hole 12 FIG. 2 eliminated and still keep an egg 600 FIG. 12-18 stable, for example, with the use of a separate adhesive paste designed to be food safe and allow an egg to adhere to the surface. The embodiment may follow the contours of an egg and can be of smaller diameter or a different shape altogether as more of an oval. The main determining factor is following the contour of an eggshell. An adhesive paste may act as an adhesive or glue and helping the egg stay on the egg stand allowing the egg stand itself to not impede too much on the actual design of the egg. Depending on the size of the stand and the formulation chosen for the adhesive, the stability is rather remarkable and allows one to turn the egg 600 on its side as in FIG. 18, or even upside down if one wished. Along with the egg staying in place, the egg stand stays in the egg handle, so no eggs will drop onto the floor.

Egg stand 300 as can be seen in FIGS. 2, 3, 6, 10, 13, 16, and 17 is intended to hold an egg 600 horizontally. This egg holder is more of an oval shaped design following the contour of an egg on its side to limit interference of an egg design with size being able to become relatively small if an adhesive is utilized. The drawing shows the embodiment with a hole 8, which could be eliminated if one desires with the shape's important features being the contour of the egg and the stability of the egg on the egg holder, for example, when an adhesive is utilized.

Containers 400 as shown in FIG. 11 are configured to fit the egg holder with the egg stand 2 & 3 to be at, or near, the center of the container providing for maximum clearance between an egg and the container itself, with the container itself being of a square design, for example, to minimize water that is required.

Figure 13:
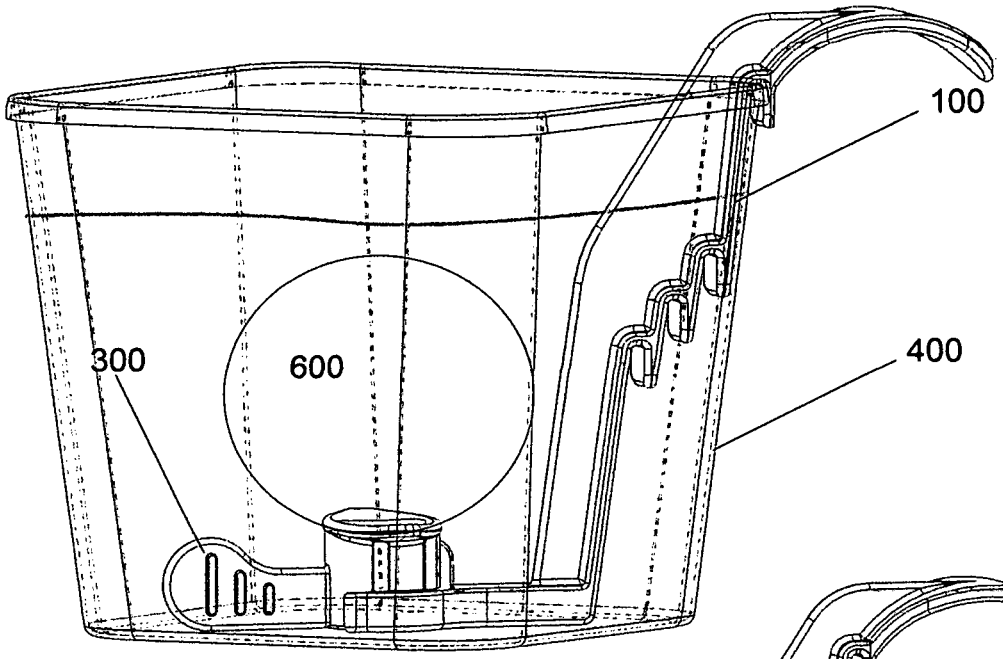

The plastic containers 400 as shown in FIG. 12, are configured at a height that is equal to the height of slot 16, which will allow a user to attach the egg handle FIG. 1 to the corner of the container 400, while also sitting on the bottom of the container to prevent movement as in FIGS. 12 & 13.

Figure 7:
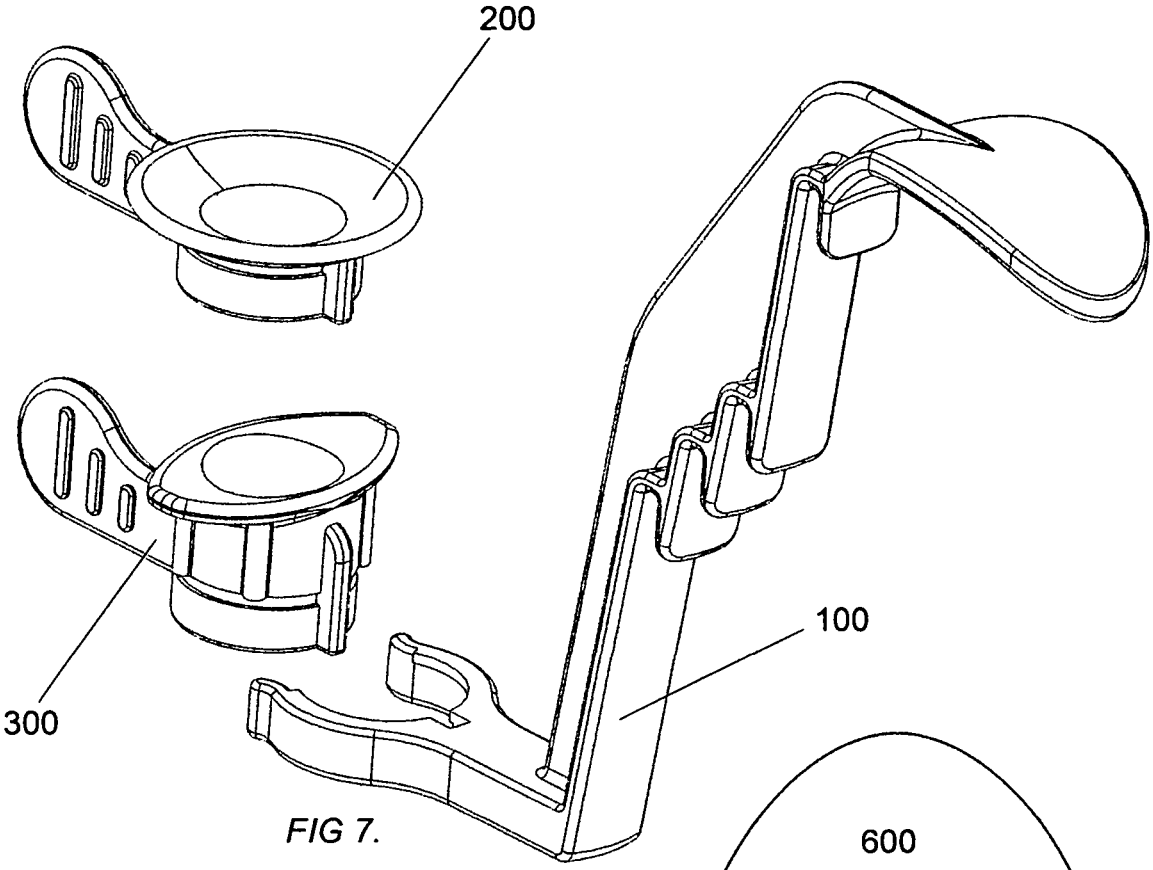

The radius of curve 20 FIG. 11 can be varied, depending on the width of slots 4 & 16 and the thickness of the actual spacing of the individual slots 4 & 16 from 5 as seen in FIGS. 1 & 7.

Figure 8:
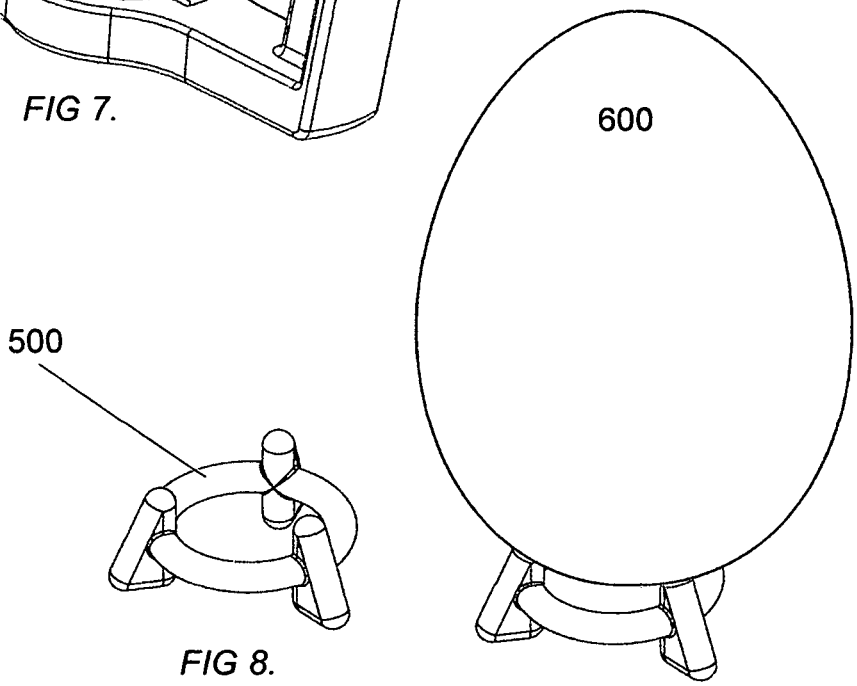
Figure 9:
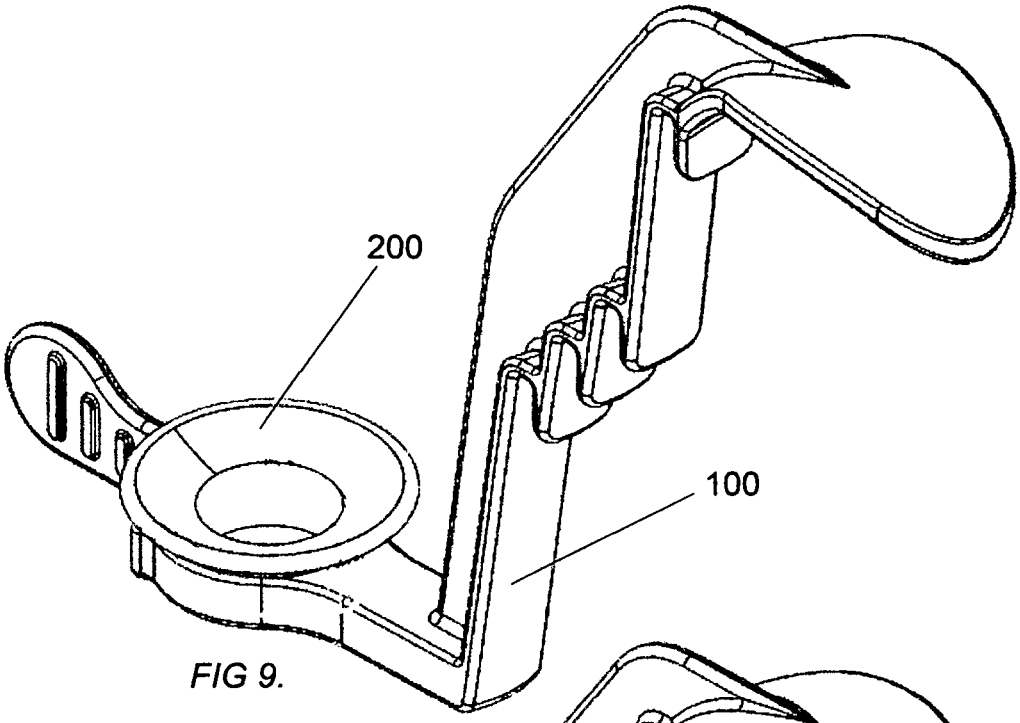
Figure 10:
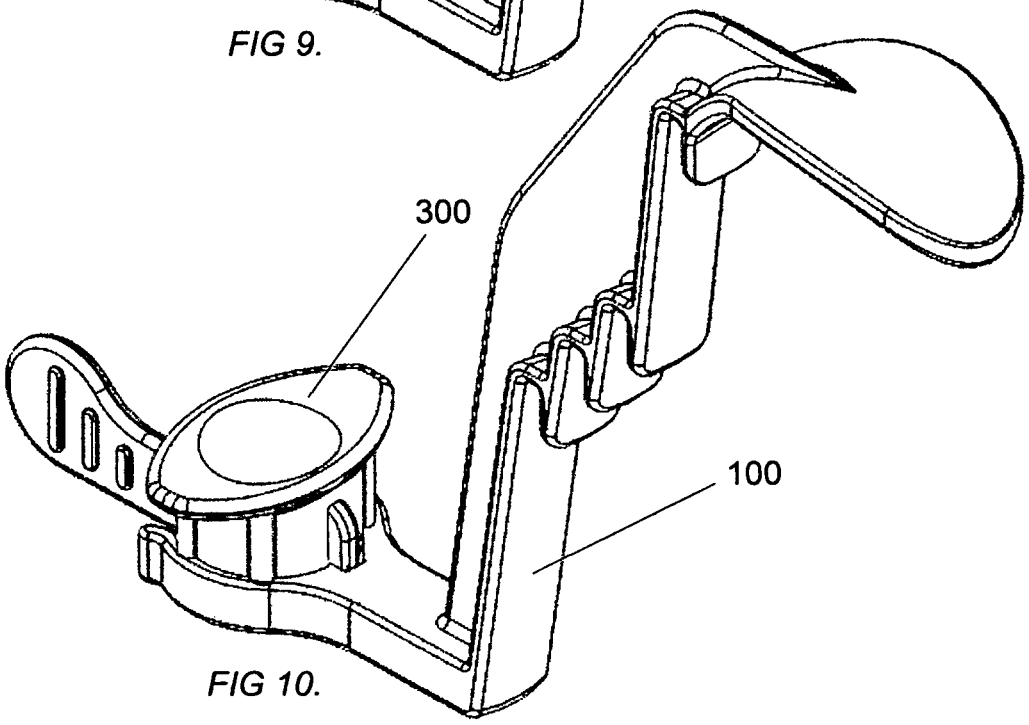

FIGS. 7, 9 & 10 show a rear perspective view of egg handle 100, and egg stands 200 and 300 not attached and attached. FIG. 8 showing an example embodiment of an egg drying stand 500 that reduces or minimizes the surface area that actually touches an egg, which helps reduce damage to one's egg design.

The egg holder provides many advantages to dyeing eggs, from preventing an egg from touching the side of the container and preventing marring of one's egg designs, to easily detachable egg stands that require no twisting or lifting to attach or detach. The device also allows users to dye only part of an egg by lifting the egg out of the water at several different heights, for example, with the configuration of the container to require minimal liquid in the container, for example, by using a square design, which will also decrease the amount of dye needed per glass.

What is claimed is:

1. An egg dipper for use in decorating eggs in a container filed with liquid dye, and securely submerging eggs in the dye at selectable heights, the egg dipper comprising:

an elongated body extending between a dipper handle and an egg stand attachment mechanism; and a detachable egg stand including a base, an egg stand handle extending from the base, and an egg stabilizer supported by the base;

wherein the egg stand attachment mechanism is configured to repeatedly receive, attach to, and detach from, the detachable egg stand via a user operating the egg stand handle; and wherein the elongated body includes a first slot positioned on an underside thereof adjacent the dipper handle and configured to attach to a rim of the container while an egg is held on the detachable egg stand to be fully submerged in the liquid dye within the container, and a series of second slots positioned further down the underside of the elongated body to attach to the rim of the container while the egg is held on the detachable egg stand to be selectively partially submerged in the liquid dye within the container.

2. The egg dipper according to claim 1, wherein the dipper handle is configured to be held with a user's finger placed on and underside of the dipper handle and a user's thumb on a top side of the dipper handle.

3. The egg dipper according to claim 1, wherein the egg stand attachment mechanism comprises two arms configured to firmly grasp the base of the detachable egg stand.

4. The egg dipper according to claim 3, wherein the egg stand attachment mechanism includes an anti-rotation feature to prevent relative movement between the egg stand attachment mechanism and the detachable egg stand while attached together.

5. The egg dipper according to claim 3, wherein the two arms comprise arcuate arms that together extend greater than 180 degrees.

6. The egg dipper according to claim 1, wherein the egg stand attachment mechanism and the detachable egg stand are each configured to horizontally slide together for attachment and slide apart for detachment via the user operating the dipper handle and the egg stand handle.

7. The egg dipper according to claim 1, wherein the first and second slots of the elongated body are configured to stabilize and level the egg held by the detachable egg stand during submersion into the liquid dye within the container.

8. The egg dipper according to claim 7, wherein the elongated body and detachable egg stand are configured to keep the egg from touching any surface of the container when fully submerged and when partially submerged.

9. The egg dipper according to claim 1, wherein the egg stabilizer of the detachable egg stand is contoured to stabilize the egg when in a horizontal position and when in a vertical position.

10. The egg dipper according to claim 9, wherein the egg stabilizer includes an opening in a top surface thereof.

11. The egg dipper according to claim 1, further comprising additional detachable egg stands for alternate attachment to and detachment from the egg stand attachment mechanism.

12. An egg dipping set comprising:

a container configured to be filled with liquid dye and generally square-shape as a square; and an egg dipper for use in decorating eggs in the container filed with liquid dye, and for securely submerging eggs in the liquid dye at selectable heights, the egg dipper including an elongated body extending between a dipper handle and an egg stand attachment mechanism, and a detachable egg stand including a base and an egg stabilizer supported by the base;

wherein the egg stand attachment mechanism is configured to repeatedly receive, attach to, and detach from, the detachable egg stand; and wherein the elongated body includes a first slot positioned on an underside thereof adjacent the dipper handle and configured to attach to a rim of the container thereof while an egg is held on the detachable egg stand to be fully submerged in the liquid dye within the container, and a series of second slots positioned further down the underside of the elongated body to attach to the rim of the container thereof while the egg is held on the detachable egg stand to be selectively partially submerged in the liquid dye within the container.

13. The egg dipping set according to claim 12, wherein corners of the top of the container are configured to fit within the first and second slots of the elongated body, and walls of the container are angled outwardly to accommodate the egg holder.

14. The egg dipping set according to claim 13, wherein the detachable egg stand is configured to be centered within the container when fully submerged within the container to keep the egg away from sides of the container.

15. An egg dipper for use in decorating eggs in a container filed with liquid dye, and securely submerging eggs in the dye at selectable heights, the egg dipper comprising:

an elongated body extending between a dipper handle and an egg stand attachment mechanism; and a detachable egg stand including a base and an egg stabilizer supported by the base;

wherein the egg stand attachment mechanism is configured to repeatedly receive, attach to, and detach from, the detachable egg stand; and wherein the elongated body includes a plurality of slots positioned on an underside thereof and configured to attach to a rim of the container while an egg is held on the detachable egg stand to selectively be fully submerged in the liquid dye within the container and to be partially submerged in the liquid dye within the container.

16. The egg dipper according to claim 15, wherein the egg stand attachment mechanism comprises two arms configured to firmly grasp the base of the detachable egg stand.

17. The egg dipper according to claim 15, wherein the egg stand attachment mechanism includes an anti-rotation feature to prevent relative movement between the egg stand attachment mechanism and the detachable egg stand while attached together.

18. The egg dipper according to claim 15, wherein the plurality of slots of the elongated body are configured to stabilize and level the egg held by the detachable egg stand during submersion into the liquid dye within the container.

19. The egg dipper according to claim 15, wherein the egg stabilizer of the detachable egg stand is contoured to stabilize the egg when in a horizontal position and when in a vertical position.

20. The egg dipper according to claim 15, further comprising additional detachable egg stands for alternate attachment to and detachment from the egg stand attachment mechanism.

21. The egg dipper according to claim 15, wherein the egg stand attachment mechanism and the detachable egg stand are each configured to horizontally slide together for attachment and slide apart for detachment.

* * * * *